United States Patent [19]

Jones

[11] Patent Number: 4,873,858

[45] Date of Patent: Oct. 17, 1989

[54] MANUFACTURE OF WIRE BINDING ELEMENTS

[75] Inventor: Leonard W. N. Jones, Surrey, Great Britain

[73] Assignee: James Burn International Ltd., United Kingdom

[21] Appl. No.: 196,365

[22] Filed: May 19, 1988

[30] Foreign Application Priority Data

May 22, 1987 [GB] United Kingdom ..... 8712149

[51] Int. Cl.[4] ..... B21F 45/16

[52] U.S. Cl. ..... 72/312; 140/71 R

[58] Field of Search ..... 140/71 R, 105, 82; 72/312, 465, 306

[56] References Cited

U.S. PATENT DOCUMENTS 3,556,166 1/1971 Whitney ..... 140/71 R 3,566,927 3/1971 Adams ..... 140/71 R 3,585,838 6/1971 Newlon ..... 72/465

*Primary Examiner*—Lowell A. Larson

*Attorney, Agent, or Firm*—Wood, Herron & Evans

[57] ABSTRACT

A machine for transforming zig-zag wire to slotted tubular form ready for use as a binding element comprising means for feeding a strip of zig-zag wire longitudinally, means for momentarily arresting the feed of each prong of the wire strip as it reaches a shaping station, means for clamping each prong at that station and means for shaping each clamped prong into the desired configuration characterised in that the clamp is operated by clamp actuation means at least twice for each revolution of rotary feed means. This has the advantage that the clamping means may be operated at much lower speeds than the feed means and the shaping means thus allowing the output ot be increased by at least fifty percent over known machines with no danger of overheating.

5 Claims, 5 Drawing Sheets

MANUFACTURE OF WIRE BINDING ELEMENTS

This invention relates to the manufacture of wire binding elements for perforated sheets.

A well known method of binding perforated sheets uses binding elements which are lengths of wire bent so as to form curved prongs on which the sheets are impaled. The element is provided at the time of the impaling operation in the form of a tube having a longitudinal slot in its wall and the final stage in the binding process is to close the slot by bringing the closed ends of the prongs into their open ends.

Such elements are generally manufactured by firstly converting a length of wire to the so-called 'zig-zag' form, hereinafter referred to as a strip of zig-zagged wire of the kind set forth, in which the wire assumes the shape of a flat comb of indefinate length, the prongs of which are 'closed' at their tips and 'open' at their bases or roots which are connected to their neighbours by aligned lengths of wire forming the stock or spine of the comb so that the pitch of the prongs corresponds to the pitch of the perforations in the sheets to be bound. A long length of such flat zig-zag material is then bought to the slotted tube form, hereinafter referred to as the slotted tubular form as set forth herein, by suitable bending of the prongs.

The conversion of a strip of zig-zagged wire of the kind set forth to the slotted tubular form may be effected in several different ways. One machine which has been used has means for feeding the strip longitudinally, means for momentarily arresting the feed of each prong as it reaches a shaping station, means for clamping each prong at that station and means for shaping each clamped prong into the desired configuration. Such a machine will hereinafter be referred to as 'a binding element forming machine of the type described'.

In such binding element forming machines the prongs of the strip of zigzagged wire must be clamped during each shaping operation and therefore the clamping means have commonly been operated at the same speed as the feed means and the shaping means. The output of known machines has therefore been restricted by the speed at which the clamping means may be operated without excess heating due to friction occuring.

A clamping means for a binding element forming machine of the type described in accordance with the present invention comprises a clamp, clamp actuation means, and a rotary feed means, wherein the clamp is operated by the clamp actuation means at least twice for each revolution of the rotary feed means.

This arrangement has the advantage that the clamping means can be operated at a much lower speed than the feed means and the shaping means of the binding element forming machine of the type described thus allowing the output to be increased by at least 50% over known machines with no danger of overheating Preferably the clamp actuation means comprises at least one multiple-lobe cam which acts directly on a follower connected to the clamp. The or each multiple-lobe cam is provided on a shaft which is driven by the rotary drive means. Thus for each rotation of the cam shaft the clamp will be actuated at least twice. The or each multiple lob cam is suitably designed with 'low lift' which allows very accurate control of the prongs of the strip of zigzagged wire.

Preferably also the clamp is provided as a pressure pad formed from three layers, an inner and outer layer of metal or metal alloy and an intermediate layer of a compressible plastics material with a fast recovery rate. This improves the positional control of the strip of zigzagged wire since the plastics material absorbs the shock when the pad is forced down onto the prongs.

Advantageously the feed means and/or the shaping means of the binding element forming machine of the type described have a rotary drive and the rotary drive means comprises a gear train which connects the cam shaft to the rotary drive of the feed means and/or the shaping means. The gear train is arranged to reduce the speed of rotation of the cam shaft to that required for the clamp to be actuated during each shaping operation. The binding element forming machine can therefore be driven by a single drive with the clamping means operating at a lower speed than the feed means and shaping means whilst still operating in the desired manner.

In a preferred embodiment the clamp actuation means comprises two double-lobe cams mounted on a gear driven cam shaft.

The invention will now be further described by way of example with reference to the accompanying drawings in which.

Figure 1:
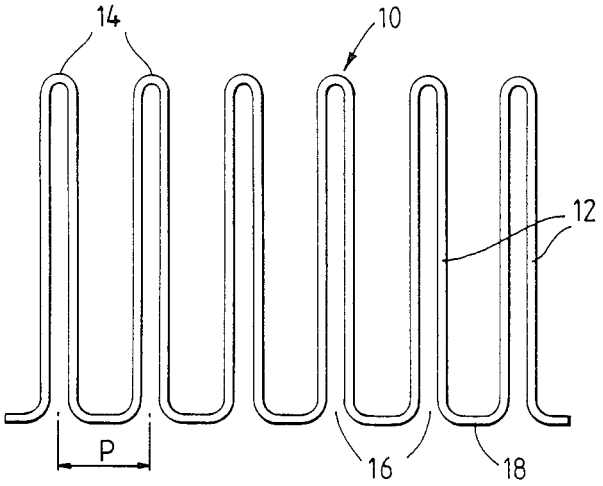
FIG. 1 shows a strip of zig-zag wire for use in a binding element forming machine of the type described.
Figure 2:
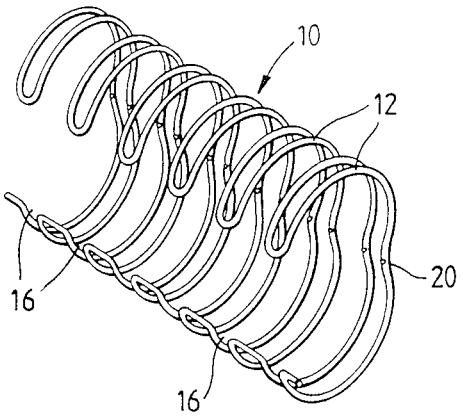
FIG. 2 shows a length of slotted tube formed from the wire shown in FIG. 1.

The strip 10 shown in FIG. 1 is comblike having prongs 12 closed at their tips 14 and open at their roots 16 where they are connected by lengths of wire 18. In the condition of use illustrated in FIG. 2 the prongs 12 have been curved so that perforated sheets can be impaled. That operation being performed, the binding is completed by bringing the tips 14 of the prongs into their roots or open ends 16, which is facilitated by an indentation on either the convex or the concave surface of that part of each prong which is midway between its tip and root 20.

Figure 3:
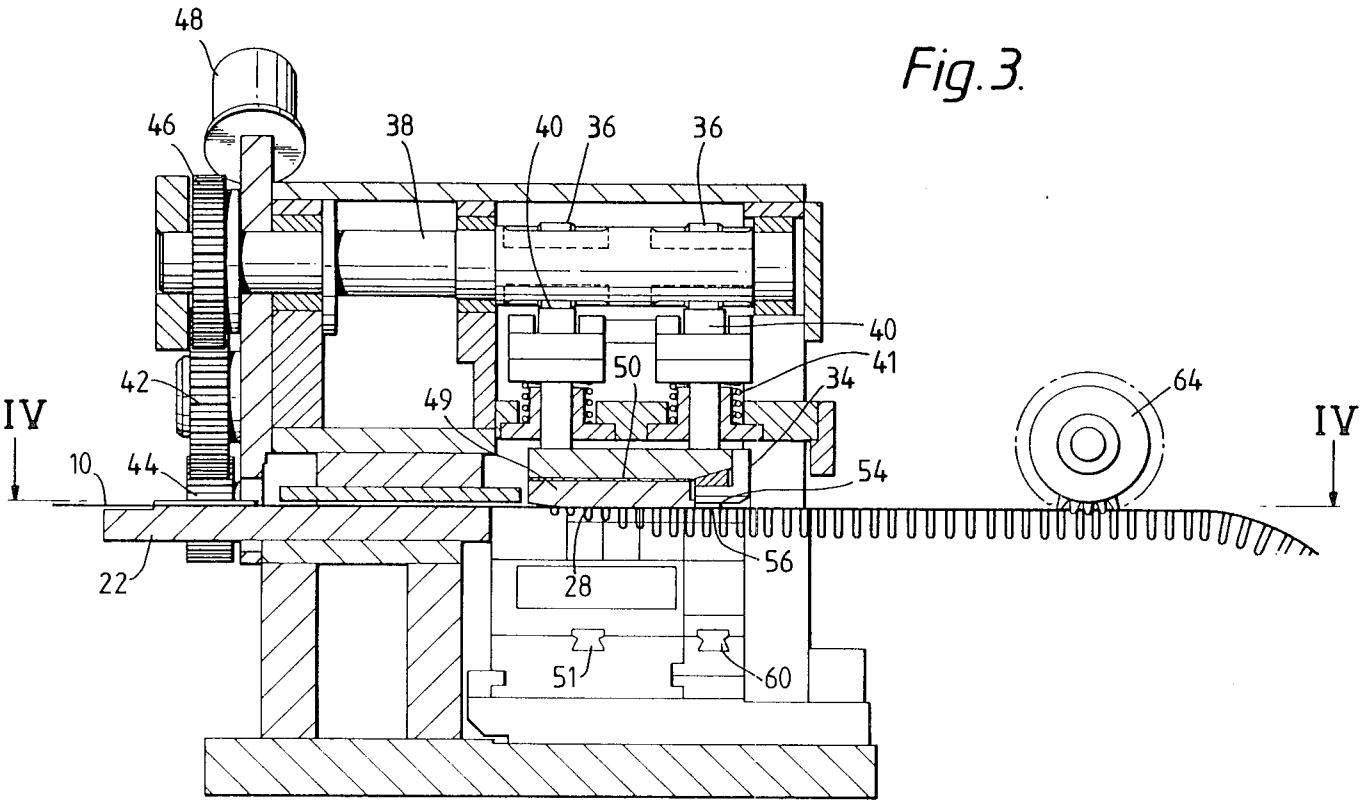
FIG. 3 is part sectional side view of a binding element forming machine of the type described incorporating clamping means in accordance with the invention.
Figure 6:
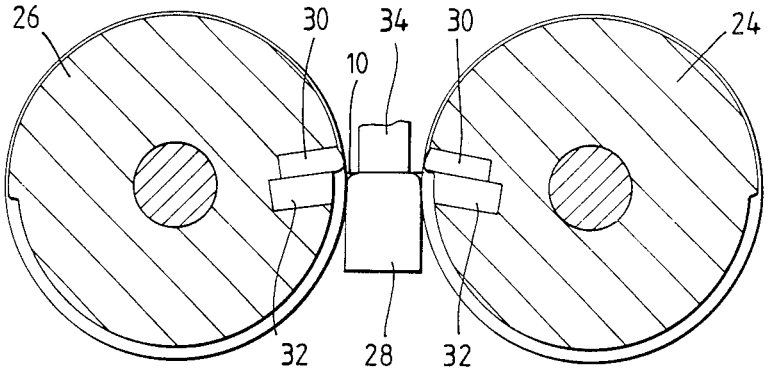
FIG. 6 is a section of the shaping means for the binding element forming machine.

Referring to FIG. 3 onwards the machine has a feed table 22 on which the zigzag strip 10 is lonitudinally fed. It is thus presented to a pair of stepped rollers 24, 26 (see FIG. 6, 7) which have been omitted from FIG. 3 but whose positions are indicated.

The stepped roller 24 has a helical groove or scroll the pitch of which is that of the prongs of the zig-zag strip and the width of which is the dimension P in FIG. 1. The stepped roller 26 has a similar groove of the same pitch but of opposite hand and the width of which is that of a tip of the prong 12 of the zig-zag strip. Rotation of the cylinders in opposite directions with the strip engaged in their grooves results in longitudinal movement of the strip over the table 22.

The table 22 has an extension 28 the width of the top of which is such that when a tooth of the zig-zag passes on to the extension 28 from the table 22 its ends project beyond the edges of the extension and lie in the grooves of the scrolls. A guide is provided along the feed table to align the zig-zag strip accurately before it reaches the scrolls.

A portion of each convolution of the scrolls is straight, i.e. lies in a plane at right angles to the longitudinal axis of the cylinder. When the zigzag strip is engaged in that part of the grooves its progression along the table 22 is arrested. This is described in greater detail in coterminously filed Application No.

The shaping of the prong is effected at this moment when the strip is held stationary above the extension 28 which acts as an anvil. Rotary hammers (30) (see FIG. 6) mounted on the rollers 24, 26 are arranged to strike the overhanging portions of the prong and cause them to bend to a shape determined by the anvil. Centralisation of the prongs on the anvil 28 is achieved by a platform or cam surface 32 provided in each groove of the scrolls in a position such that it engages the overmost part of each prong before it is clamped. The platforms on opposing rollers are adjusted to the exact width of the wire and are arranged to engage the wire simultaneously.

In further convolutions of the grooves there are further hammers at greater radial distances from the longitudinal axis of the cylinder which, on continued rotation of the latter, cause the partially bent zigzag to be further bent until the final tubular form is achieved. The shaping means and the roller drive are more fully described in our simultaneously filed Application No. XXX To enable the hammers to work effectively, the central parts of the prongs are held by a pressure pad 34 which is caused by a clamp actuation means to grip the strip between itself and the anvil 28 at appropriate times.

In operation of the binding element forming machine, the zigzag strip is fed along the feed table 22 and the connecting lengths of wire 18 and the tips 14 enter the helical grooves on the rollers 24 and 26 respectively. The rotation of the rollers 24, 26 causes the strip of zigzagged wire to advance along the extension 28 This movement is arrested when the tips 14 and connecting lengths of wire 18 are in the straight portions of the helical grooves. The pressure pad 34 then clamps the portion of the zigzag wire which is on the anvil 28 against the anvil 28 The tips and connecting lengths of wire are then hit by the hammers mounted in the helical grooves. The pressure pad is raised and the zigzag wire resumes its movement along the extension 28. The clamp actuation means must therefore operate so that they cause the strip to be clamped when its movement along the extension 28 is arrested.

Figure 5:
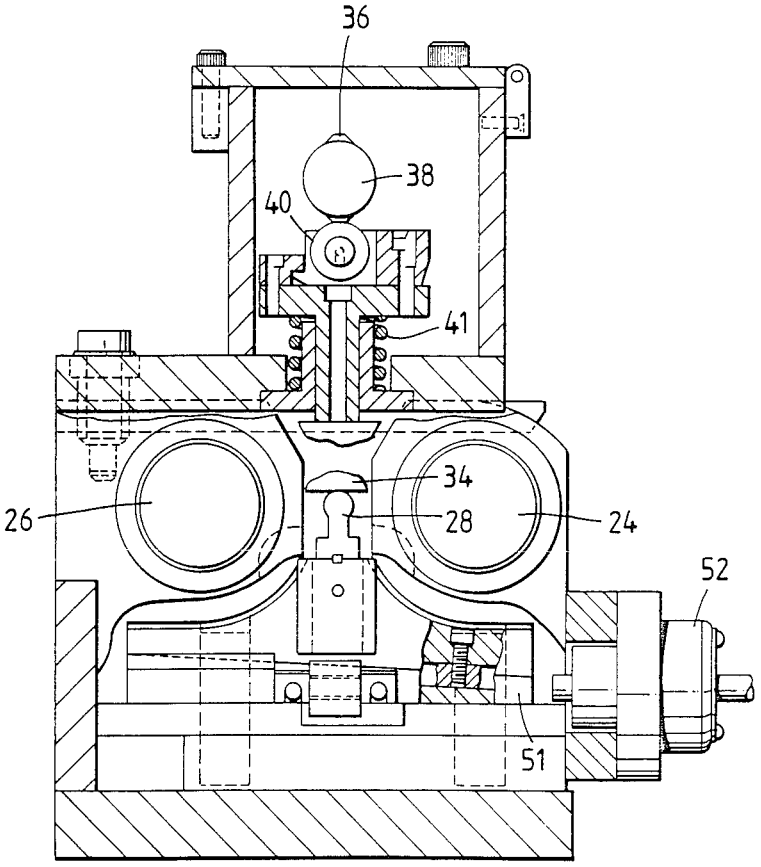
FIG. 5 is a part sectional view taken in the direction of arrows V—V of FIG. 3.

The clamp actuation means (see FIGS. 3 and 5) comprises two double-lobe cams 36 with low lift ie. with only a small verticle distance between the highest and lowest points of the cam surface, mounted on a cam shaft 38 which act directly onto two followers 40. The cam shaft is driven from the main roller drive by means of an idler gear 42 which connects the main drive gear 44 to a cam shaft drive gear 46. The followers 40 are connected to the pressure pad 34. As the cams 35 are rotated on the cam shaft 38 they cause the followers 40 to move downwards thereby forcing the pressure pad 34 onto the anvil 28. Once the cams have moved past the followers the followers and the pressure pad are raised by the action of springs 41 (see FIG. 5). The followers 40 are adjustable so as to change the vertical position of the pressure pad and allow the machine to be used with wire of different diameters. A cam box is preferably totally enclosed and provided with a lubricant bath supplied from an oil reservoir 48 to aid lubrication and to disperse heat.

The output from the shaping means is increased over that from known machines where single lobe cams are used because the double lobes allow the cam shaft to run at half the speed of the scrolls. This enables the output of the machine to be increased whilst resisting the possibility of overheating. The 'low lift' causes the stroke of the pressure pad to be small thus allowing improved control of the movement of the zigzag wire.

The pressure pad 34 is preferably formed from an inner and outer layer of steel 49 and an intermediate layer 50 of a compressible plastics material with a fast recovery rate. The plastics material absorbs the shock when the pad is forced down onto the prongs and thus improves control of the prongs.

To provide an alternative to varying of the vertical position of the pressure pad by adjustment of the followers the anvil 28 is split so that it can be raised or lowered through the action of wedges 51. The wedges are driven by a DC servo motor 52 which may be linked to a control unit. This allows the binding element forming machine to be adjusted whilst operating, rather than having to stop the machine and adjust the cam mechanism as is the case in known machines.

Figure 7:
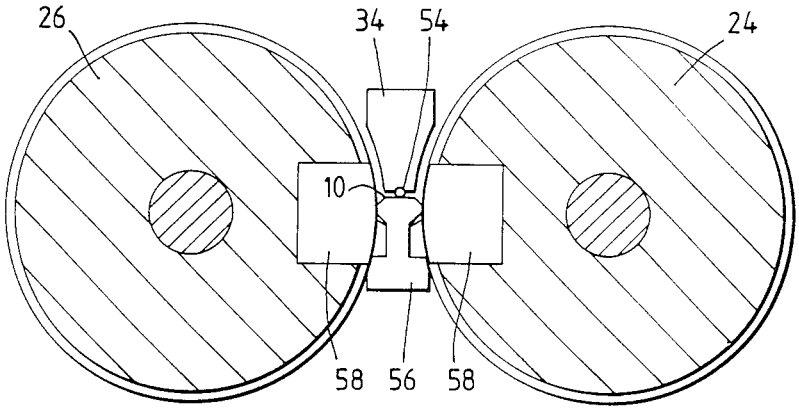
FIG. 7 is a view similar to that of FIG. 6 but showing a later stage of the forming process.

The pressure pad 34 has a projection 54 (FIG. 7) which serves to put the indentation referred to above into the convex side of the prongs in the last stage of forming. An anvil extension 56 has a depression matching the projection 54. An insert 58 on each scroll controls the position of the prongs on the anvil extension 56 such that they are centralised prior to clamping. The anvil extension is also split and may be adjusted by wedge 60 driven by a second DC servo motor 62. The indentation forming operation can thus be controlled whilst the machine is in operation. The DC servo motor 62 may also be linked to the control unit to allow the position of the anvil 28 and the anvil extension 56 to be varied simultaneously.

The indentation may be formed on the concave side of the prongs by providing the forming tool on the anvil extension and a corresponding depression on the pressure pad 34. It has been found that this is preferable to forming the indentation on the convex side of the prongs as it more effectively facilitates bending in the final binding operation. The indentation may be produced by a cutting or a forming operation.

Alternatively the indentation may be produced before the zigzag wire is converted to the slotted tubular form by a similar operation i.e. with a projection on one of the anvil 28 or the pressure pad 34 and a corresponding depression in the other. This has the advantage that it further aids centralisation of the prongs.

Figure 4:
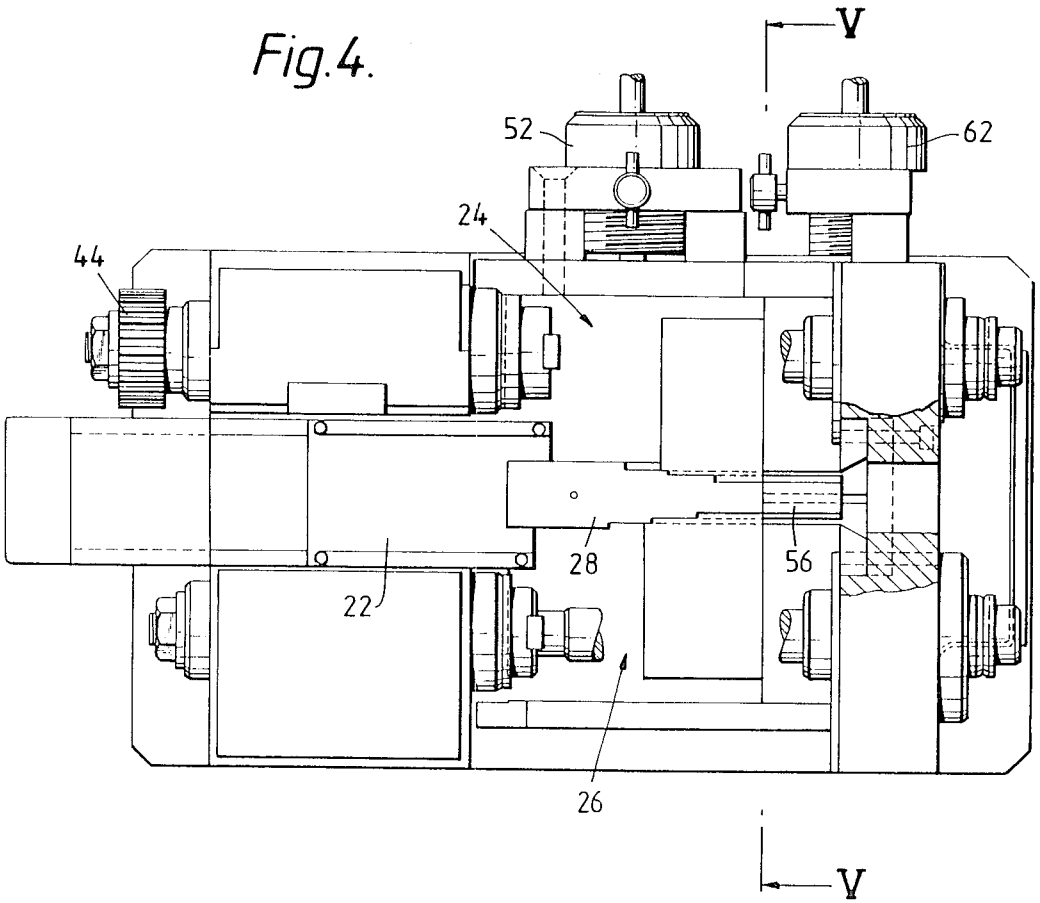
FIG. 4 is a plan view in the direction of arrows IV—IV of FIG. 3.

A starwheel 64 is provided at the exit end of the machine (FIG. 4) to control and adjust the pitch of the binding elements to the required dimensions.

I claim:

1. A binding strip forming machine comprising rotary feed means for feeding a multi-prong binding strip into a forming station in response to rotation of said feed means, forming means located at said forming station for forming successive prongs of said multi-prong binding strip into a desired configuration, arresting means connected with said rotary feed means for arresting the feed of successive prongs in said forming station, clamp means located at said forming station for clamping successive prongs in place at said forming station during forming thereof, and rotary clamp actuation means connected between said rotary feed means and said clamp means, said clamp actuation means causing said clamp means to function in response to rotation of said clamp actuation means, said rotary feed means completing at least two revolutions for each revolution completed by said clamp actuation means.

2. A machine as set forth in claim 1, said clamp actuation means comprising at least one multiple-lobe cam which acts directly on a follower connected to said clamp means.

3. A machine as set forth in claim 2, said clamp means comprising a pressure pad formed from an inner and outer layer of a metal and an intermediate layer of a compressable plastic material having a fast recovery rate.

4. A machine as set forth in claim 1, at least one of said rotary feed means and said forming means comprising a rotary drive comprising a gear train drivingly connected to a cam shaft to actuate said clamp means, said gear train also being drivingly connected to that one of said rotary feed means and said forming means, said gear train functioning to reduce the speed of rotation of said cam shaft to that required so that said clamp is actuated when forming said binding strip.

5. A machine as set forth in claim 1, said clamp actuation means comprising two double-lobe cams mounted on a gear driven cam shaft.

* * * * *

UNITED STATES PATENT AND TRADEMARK OFFICE

CERTIFICATE OF CORRECTION

PATENT NO. : 4,873,858

DATED : October 17, 1989

INVENTOR(S) : L.W.N. Jones

It is certified that error appears in the above-identified patent and that said Letters Patent is hereby corrected as shown below:

Title page:

In the Abstract - Line 13 "ot" should be --to--

Column 3, line 62 "35" should be --36--

Signed and Sealed this

Eleventh Day of June, 1991

*Attest:*

HARRY F. MANBECK, JR.

*Attesting Officer*

*Commissioner of Patents and Trademarks*